US005799709A

United States Patent [19]

Shipley

[11] Patent Number: 5,799,709

[45] Date of Patent: Sep. 1, 1998

[54] PAPERMAKING FABRIC SEAM WITH SEAM FLAP ANCHOR

[75] Inventor: Gale Shipley, Mauldin, S.C.

[73] Assignee: Asten, Inc., Charleston, S.C.

[21] Appl. No.: 920,700

[22] Filed: Aug. 29, 1997

[51] Int. Cl.[6] ..... D03D 13/00

[52] U.S. Cl. ..... 139/383 AA; 428/58; 162/904

[58] Field of Search ..... 428/58; 442/270; 139/383 AA; 24/33 P, 33 C; 162/348, 904; 28/141

[56] References Cited

U.S. PATENT DOCUMENTS

| | | | |
|---|---|---|---|
| 3,316,599 | 5/1967 | Wagner | 139/383 AA |
| 4,182,381 | 1/1980 | Gisbourne | 139/383 AA |
| 4,186,780 | 2/1980 | Josef et al. | 139/383 AA |
| 4,601,785 | 7/1986 | Lilja et al. | 139/383 AA |
| 4,842,925 | 6/1989 | Dufour et al. | 139/383 AA |
| 4,979,543 | 12/1990 | Moriarty | 139/383 AA |
| 5,188,884 | 2/1993 | Smith | 139/383 AA |
| 5,458,161 | 10/1995 | Scarfe | 139/383 AA |
| 5,476,123 | 12/1995 | Rydin | 139/383 AA |
| 5,531,251 | 7/1996 | Rydin | 139/383 AA |

*Primary Examiner*—Andy Falik
*Attorney, Agent, or Firm*—Volpe & Koenig, P.C.

[57] ABSTRACT

An open ended papermaker's fabric woven from a longitudinal thread system and a transverse thread system and having a plurality of seam loops at each end of the fabric formed by the threads of the longitudinal thread system. At least one additional transverse thread is interwoven with the longitudinal thread system in at least one seam zone in a repeat pattern that passes over at least two adjacent paper side longitudinal threads and under at least one machine side longitudinal thread.

7 Claims, 4 Drawing Sheets

PAPERMAKING FABRIC SEAM WITH SEAM FLAP ANCHOR

BACKGROUND OF THE INVENTION

1. Field of the Invention

The present invention generally relates to a woven fabric which is designed for use in a papermaking, cellulose or board manufacturing machine and which along each end has a plurality of loops to be included in a loop seam to form an endless woven fabric.

2. Description of the Prior Art

As will be known to those skilled in the art, papermaking machines generally include three sections which are generally referred to as the forming, press and dryer sections. The present invention finds particular application in papermaker's felts which are employed in the press section of a papermaking machine.

Typically, such felts include a supporting base, such as a woven fabric, and a paper carrying or supporting layer fixed to the base. Frequently, the support layer is a non-woven batt material having homogeneous characteristics, such as permeability, compaction and drainage, which is affixed to the base.

Base fabrics are typically woven fabrics which are used as an endless loop. Such an endless loop may be woven as an endless fabric having no seam, or alternatively, the fabric may have two ends which are joined at a seam. Typical seams include pin type seams which utilize a pintle inserted through seam loops to close the fabric.

FIG. 1 shows a prior art pin type seam with the ends joined by a pintle. A seam zone free of CMD yarns is created in the area around the seam. As a result, the batt material has less surface contact points to attach to and therefore, is less effectively anchored in the seam zone.

Prior art reveals an increased material anchorage in the seam zone via use of a thread woven parallel to the cross direction threads only on the paper side of the fabric. Surface contact of this thread is estimated to be approximately 50%.

However, there exists a need to provide greater surface contact in the seam zone for better batt anchorage.

SUMMARY OF THE INVENTION

The present invention generally provides an open ended papermaker's fabric woven from a longitudinal thread system and a transverse thread system. A plurality of seam loops are formed at each end of the fabric by the threads of the longitudinal thread system whereby a seam zone is formed at each end of the fabric between the respective seam loops and a respective end thread of the transverse thread system. At least one additional transverse thread is interwoven with the longitudinal thread system in at least one seam zone. The additional thread is woven in a repeat pattern that passes over at least two adjacent paper side longitudinal threads and under at least one machine side longitudinal thread. A method of producing such a papermaker's fabric is also provided.

DESCRIPTION OF THE PREFERRED EMBODIMENT

Figure 1:
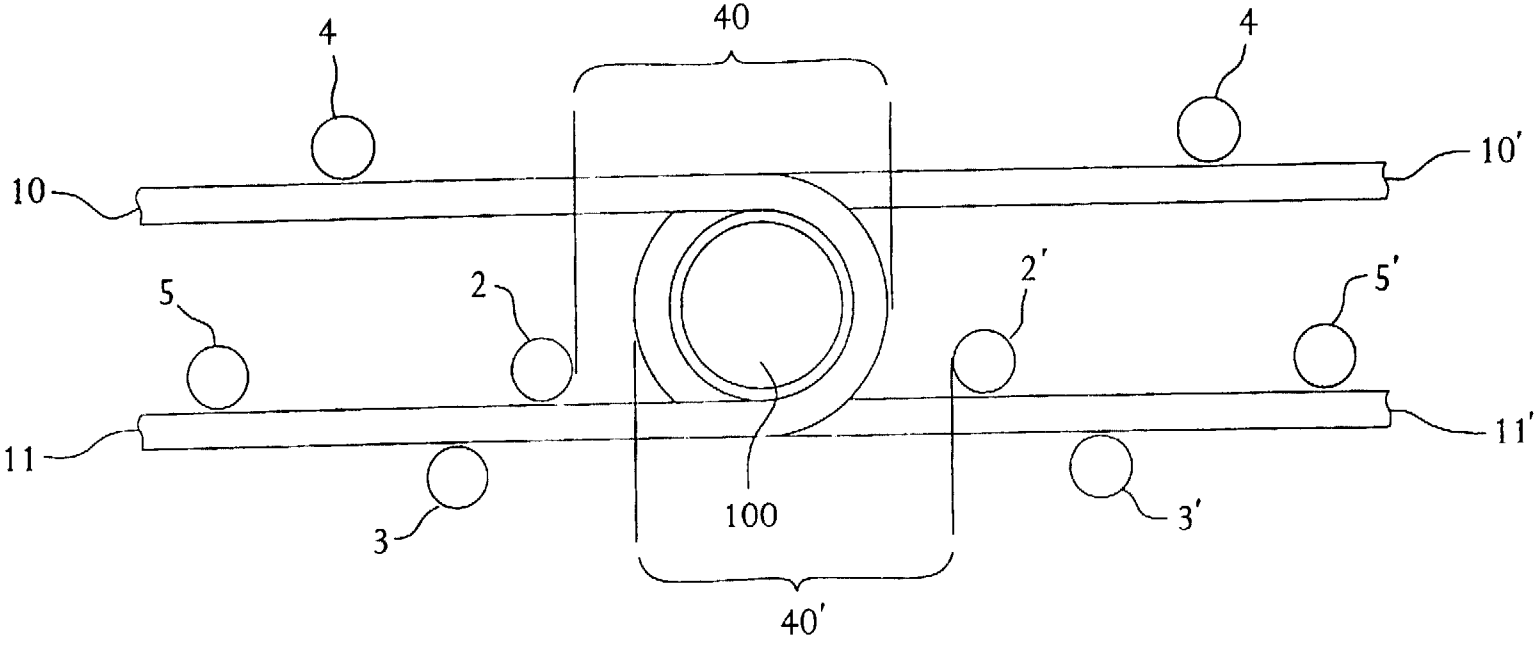
FIG. 1 PRIOR ART
FIG. 1 is a side elevation of a prior art pin seam.

The preferred embodiment will be described with reference to the drawing figures where like numerals represent like elements throughout.

Figure 2:
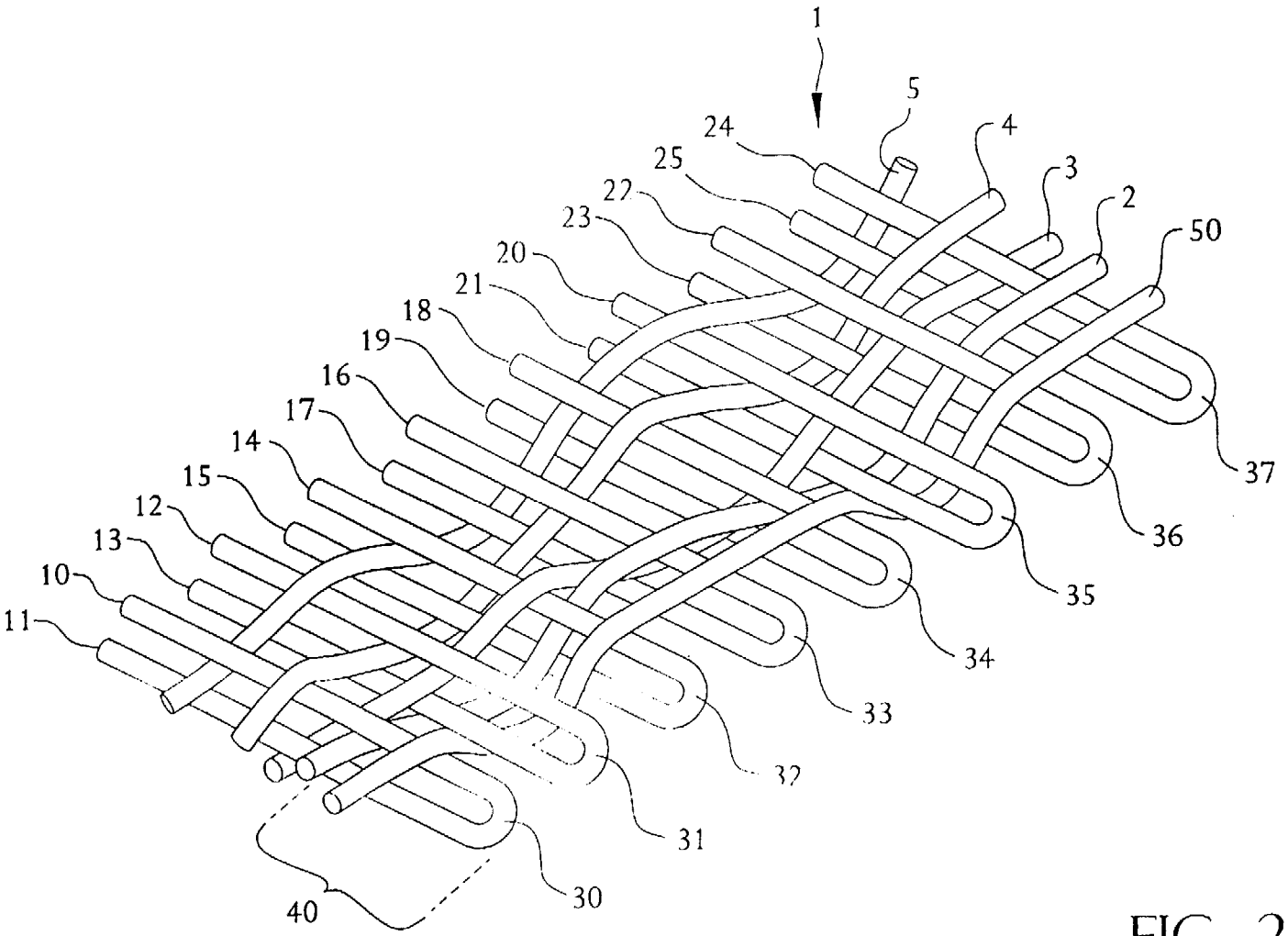
FIG. 2 is a schematic perspective view of a portion of the base fabric of the present invention.

Referring to FIG. 2, it shows a portion of the base fabric 1 in accordance with the present invention. The base fabric 1 comprises a top layer of MD threads, identified in that layer as 10, 12, 14, 16, 18, 20, 22, and 24, and a bottom layer of MD threads, identified in that layer as 11, 13, 15, 17, 19, 21 and 23. It will be understood that the top and bottom layers are essentially continuous threads which form the seam loops 30–37 respectively between the top and bottom layers.

CMD threads 2–5 are interwoven with the top and bottom MD thread layers. A seam zone 40 exists between the end CMD thread 2 and the seam loops 30–37. In the preferred embodiment, the CMD threads 2–5 are woven in a repeated pattern where each CMD thread 2–5 passes over, between, under, between with respect to the threads of the two MD layers.

In the preferred embodiment, at least one additional CMD thread 50 is interwoven in the seam zone 40 with both layers of MD threads. The additional CMD thread 50 preferably weaves in a repeat that passes under one pair of MD threads 12–13 and over three pairs of MD threads 14–19.

Figure 3:
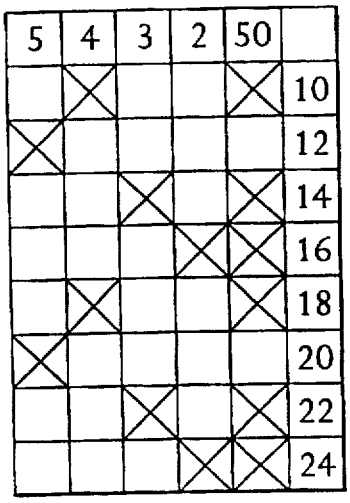
FIG. 3 is a weave pattern diagram for the upper layer of the base fabric.
Figure 4:
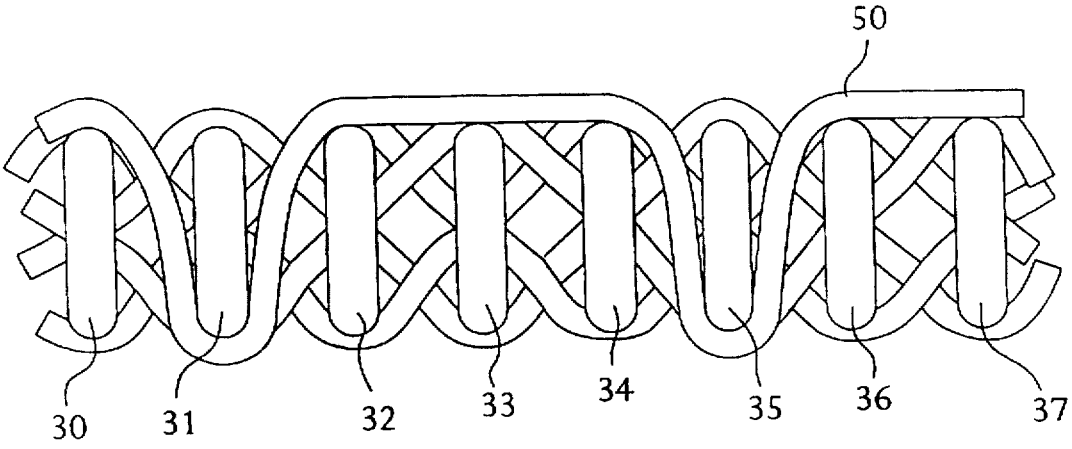
FIG. 4 is an elevation view of the fabric taken along line 4—4 in FIG. 2.

FIG. 3 is a weave pattern diagram for the upper surface weave pattern. The filled in boxes indicate where the CMD yarns cross over the respective MD yarns. As shown in FIGS. 3 and 4, the additional CMD thread 50 is under only a single pair of MD threads in a given repeat. This provides a seam zone 40 paper support side which is dominated by the additional CMD thread 50. With this weave, the additional thread enhances the sheet side surface contact in the seam zone by between 60–80% over a seam area having no thread woven in this area. This provides a substantial advantage over the prior art which discloses a sheet side surface contact of only about 50% in the seam zone.

Figure 5:
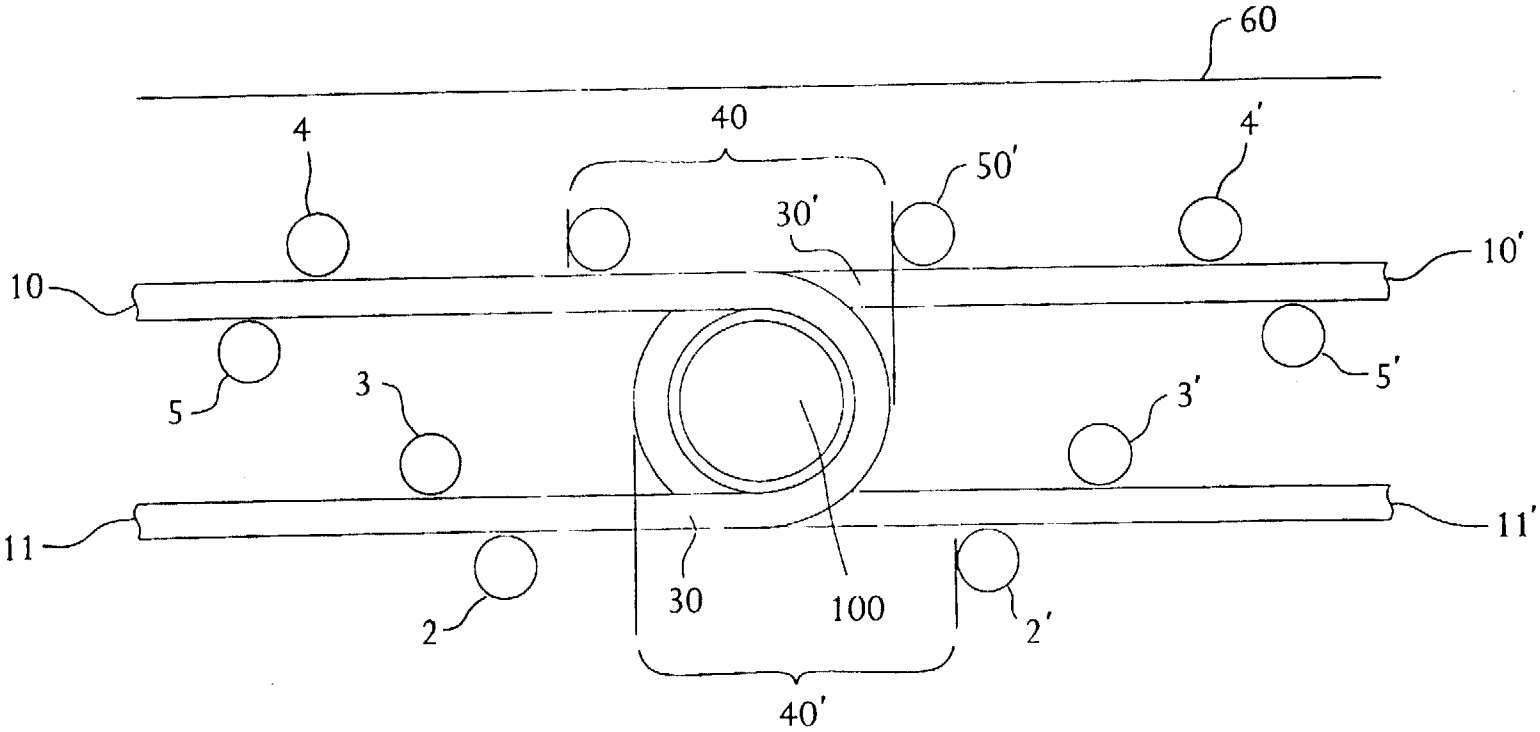
FIG. 5 is a side elevation view of the two ends of the fabric joined together.

FIG. 5 shows a finished seam of the preferred embodiment. The ends of the fabric are brought together and seam loops 30–37 are intermeshed with corresponding seam loops 30'–37'. A pintle 100 is passed through the loops to join the ends of the base fabric 1. Batt material 60 may be anchored to the base fabric 1 before or after it is seamed. The batt material 60 is generally anchored to at least the surface CMD threads. The additional CMD threads 50, 50' provide extra anchorage sites for the batt material 60 in the seam zone 40. As a result, the batt material 60 is more effectively anchored in the seam zone 40 and the seam zone batt is more uniform with the remainder of the fabric.

The additional CMD thread 50 can be multifilament, spun, braided, knitted, or bicomponent. If the thread is of a bicomponent nature, the bicomponent material may have a core material with a higher melting point surrounded by a covering of a lower melting point material. This allows the covering to melt and adhere to the batt material during finishing without affecting the core structure of the thread. The type of polymeric resin(s) may be selected from a group consisting of polyamide, polyurethanes, polyesters, polyaramids, polyimides, polyolefins, polyetherketones, polypropylenes, PET, PBT, phenolics, and copolymers thereof.

I claim:

1. An improved open ended papermaker's fabric of a type woven from a longitudinal thread system and a transverse thread system and having a paper side and a machine side, a plurality of seam loops at each end of the fabric formed by the threads of the longitudinal thread system whereby a seam zone is formed at each end of said fabric between the respective seam loops and a respective end thread of said transverse thread system, the improvement characterized by:

at least one additional transverse thread interwoven with the longitudinal thread system in at least one seam zone in a repeat pattern that passes over at least two adjacent paper side longitudinal threads and under at least one machine side longitudinal thread.

2. A fabric according to claim 1 wherein at least one additional transverse thread is interwoven in each seam zone.

3. The fabric according to claim 1 wherein the additional transverse thread weaves over three adjacent paper side longitudinal threads and under one machine side longitudinal thread in a given repeat.

4. The fabric according to claim 1 further comprising a batt material anchored to the paper side of the fabric.

5. The fabric according to claim 1 wherein the additional transverse thread has a core of a first material and a covering of a second material having a lower melting point then the first material.

6. A method of producing a papermaker's fabric comprising the steps of:

interweaving a longitudinal thread system with a transverse thread system to define a base fabric having first and second ends and a paper side and a machine side;

forming a plurality of seam loops at each end of the fabric from the threads of the longitudinal thread system whereby a seam zone is formed at each end of said fabric between the respective seam loops and a respective end thread of said transverse thread system; and interweaving at least one additional transverse thread with the longitudinal thread system in at least one seam zone in a repeat pattern that passes over at least two adjacent paper side longitudinal threads and under at least one machine side longitudinal thread.

7. The method according to claim 6 further comprising the step of anchoring a layer of batt material to the paper side of the fabric.

* * * * *